US009598872B2

(12) United States Patent
Zappia

(10) Patent No.: US 9,598,872 B2
(45) Date of Patent: Mar. 21, 2017

(54) COMPOUND HOLDING DEVICE FOR RETAINING TOOLS

(71) Applicant: Lorenzo Zappia, Gloucester (CA)

(72) Inventor: Lorenzo Zappia, Gloucester (CA)

( * ) Notice: Subject to any disclaimer, the term of this patent is extended or adjusted under 35 U.S.C. 154(b) by 422 days.

(21) Appl. No.: 13/929,544

(22) Filed: Jun. 27, 2013

(65) Prior Publication Data

US 2014/0000083 A1 Jan. 2, 2014

(30) Foreign Application Priority Data

Jun. 28, 2012 (CA) ..... 2781357

(51) Int. Cl.
*E04G 21/00* (2006.01)
*B65D 25/20* (2006.01)
*B25H 3/06* (2006.01)

(52) U.S. Cl.
CPC ..... *E04G 21/005* (2013.01); *B25H 3/06* (2013.01); *B65D 25/20* (2013.01); *Y10T 29/49817* (2015.01)

(58) Field of Classification Search
CPC ..... E04G 21/005; E04G 21/00; E04G 21/02; E04G 21/20; B65D 85/00; B65D 25/20; B65D 2313/04; B25H 3/06; E04F 21/06
USPC ..... 206/350; 294/3.5; 81/490; 220/696, 695, 220/697, 660
See application file for complete search history.

(56) References Cited

U.S. PATENT DOCUMENTS 722,899 A * 3/1903 Reeder ..... B25D 1/00 81/20
1,250,328 A * 12/1917 Langford ..... B25B 15/007 7/165
1,712,343 A * 5/1929 Gerhardt ..... B25G 1/08 81/20
4,934,223 A * 6/1990 Wong ..... B25G 1/085 81/177.4
5,186,507 A * 2/1993 Neidfeld ..... E04F 21/06 294/146
5,842,394 A * 12/1998 Hwang ..... B25B 23/0035 81/439
5,868,048 A * 2/1999 Cassutti ..... B25B 15/02 81/439
6,006,936 A * 12/1999 Przybylowicz ..... B65D 25/20 220/23.8
6,272,708 B1 * 8/2001 Chen ..... B25G 1/04 15/236.01
6,279,434 B1 * 8/2001 Brown ..... A63C 17/0006 81/177.4

(Continued)

*Primary Examiner* — Steven A. Reynolds
(74) *Attorney, Agent, or Firm* — Garrett James O'Sullivan

(57) ABSTRACT

A compound-holding device for use with a working material in one embodiment comprising a plate having a top and a bottom surface. A magnet for retaining tools is mounted on the bottom surface of the plate. In another embodiment of the invention, the handle is hollow and a magnet is placed inside the handle for retaining elongated tools such as screwdrivers within the handle. Other retaining means are threading, a clip or a locking pin system. In another embodiment a pan is disclosed having a bottom surface and sides extending upwardly and outwardly therefrom. Magnets for retaining tools are mounted on the sides of the pan for holding tools. A magnet-free zone enables holding by hand without interference of protruding magnets.

11 Claims, 8 Drawing Sheets

(56) References Cited

U.S. PATENT DOCUMENTS 6,443,037 B1 * 9/2002 Chang ..... B25B 15/04 81/177.4
6,524,035 B1 * 2/2003 Robison ..... B23B 31/1071 408/211
6,637,792 B1 * 10/2003 McCoy ..... E04F 21/02 220/755
6,668,689 B1 * 12/2003 Lai ..... B25B 13/5091 335/284
7,013,516 B1 * 3/2006 Peters ..... B25D 1/02 7/146
7,364,040 B1 * 4/2008 Hunter ..... B25H 3/06 206/349
7,617,749 B2 * 11/2009 Kelland ..... B25D 1/02 81/23
7,818,843 B2 * 10/2010 Kinskey ..... B25F 1/02 15/105
8,033,199 B1 * 10/2011 Noble ..... B25G 1/08 81/23
8,037,577 B2 * 10/2011 Chen ..... B25G 1/085 16/111.1
2003/0015532 A1 * 1/2003 Rickman ..... B25H 3/006 220/212
2003/0034349 A1 * 2/2003 Frey ..... E04F 21/02 220/632
2005/0005365 A1 * 1/2005 Clemons ..... B25F 1/00 7/105
2005/0247170 A1 * 11/2005 Chen ..... B25G 1/08 81/490
2007/0029215 A1 * 2/2007 Martinez ..... E04F 21/00 206/223
2008/0000918 A1 * 1/2008 Bruno ..... E04F 21/02 220/695
2010/0154598 A1 * 6/2010 Sergyeyenko ..... B25C 11/00 81/23
2011/0290803 A1 * 12/2011 Kehres ..... E04F 21/02 220/475
2012/0067906 A1 * 3/2012 Szasz ..... B28B 7/348 220/657

* cited by examiner

COMPOUND HOLDING DEVICE FOR RETAINING TOOLS

CROSS-REFERENCE TO RELATED APPLICATIONS

This patent application claims priority to Canadian patent application number 2,781,357 filed Jun. 28, 2012 and entitled "Compound Holding Device For Retaining Tools". The subject matter of Canadian patent application number 2,781,357 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The present invention relates to a compound-holding device such as a drywall hawk or pan used for holding materials for drywall and masonry applications, which retains tools for convenient access.

BACKGROUND OF THE INVENTION

In most constructions, ceilings and walls are made of drywall. Drywall is a plaster-like substance pressed between two sheets of thick paper. Drywall is attached to the ceiling or wall using nails and screws. The seams between the drywall sheets and the nails or screws are covered using a drywall compound or spackle with the help of taping knives and spackling knives as well as trowels. Any projecting screws are driven in using screwdrivers. Finally the drywall is finished with taping several layers of the joint compound using a trowel or knives.

Drywall compound is similar to plaster and is also referred to as joint compound or mud, and this mud is held on a hawk or within a pan. Drywall and masonry hawks and pans known in the prior art usually consist of a metallic plate and a handle protruding downwardly from the center to provide a handle to hold the hawk. A cushion ring is placed between the handle and bottom surface of the metallic plate for the comfort of the worker's hand and to reduce callous formation. Materials such as drywall compound or mortar are placed on top surface of the plate while the worker applies the material to a wall or other types of surfaces using various tools as discussed above.

While working on drywall or masonry applications, a number of tools are used on a regular basis, including taping and spackling knives, as well as screwdrivers to drive protruding tools back in. Workers have to handle a number of tools keeping them in different places such as their pockets, work belts, benches and the floor, and the time spent switching between tools is considerable. Further, when on a scaffold or other elevated location, dropping a tool results in the worker having to descend and retrieve the tool before ascending to continue work. Further, the workers end up misplacing or losing tools, when the tools are located in several different places. Safety is a factor as well, as keeping in pockets are not good for the worker's safety in the case of a fall.

Therefore there is a requirement for an improved compound holding device such as a hawk and pan which solves the above mentioned problems.

SUMMARY OF THE INVENTION

The objective of the present invention is to provide an improved compound holding device such as a hawk or pan which solves the above mentioned problems and also increases the worker's efficiency by giving easy access to the various tools used in drywall or masonry applications, while working with the hawk.

According to the present invention, the improved hawk consists of a plate having a handle positioned on bottom surface 6 of the plate to hold the hawk. A cushion ring may be positioned on bottom surface of the plate, between the plate and the handle, or around the point where the handle meets the plate, for increasing the comfort of the worker holding it. One or more magnets are placed on bottom surface of the plate, between the plate and the cushion ring, so tools and other devices having ferromagnetic parts can be retained magnetically against bottom surface of the plate. In a preferred embodiment, the magnet forms a ring on bottom surface of the plate, around the handle.

In another embodiment of the invention, the improved hawk has a hollow handle containing a retention means, which may be magnetic, have a threaded engagement with a tool, a friction clamp for holding the tool by friction, a locking pin passing through the handle, or a combination of these retention means. In a preferred embodiment a magnet is placed in the handle of the hawk, and tools with ferrous materials such as screwdrivers can be retained in the handle until necessary.

Usually the tools have parts made of various types of steel or iron that are attracted to magnets. The magnet in the hawk enables the worker to place tools such as knives, trowels and screwdrivers on the hawk without making them fall. The worker can use the tools for various applications and place them back on hawk.

Further disclosed is an improved pan consists of a base with four sides extending upwardly and outwardly from the base defining an opening, such that the area of the opening is larger than that of the base. One or more magnets are mounted around the sides of the pan, either in certain locations or continually, so tools and other devices having ferromagnetic parts can be retained magnetically against the side of the pan. In a preferred embodiment, the magnet forms a ring around the sides of the pan such that tools may be retained in any convenient location on the pan.

Also disclosed is a pan for holding a working material and retaining devices, the pan comprising a base having sides extending upwardly and outwardly from the base, the sides defining an opening, such that the opening has a greater area than the area of the base; and one or more magnets coupled to the sides so as to define a magnet-free zone for a hand to hold the pan, the magnets to hold one or more devices having ferromagnetic parts. In an embodiment the magnets are continuous around the side. In a further embodiment the magnets have a low profile from the sides to reduce protrusion against the hand, when the hand is holding the pan on a portion having magnets.

A further embodiment describes a pan further comprising first and second ends at the extreme sides of the pan, wherein the magnets are mounted near ends of the pan to define the magnet-free zone. The one or more magnets may be coupled to the sides of the pan by one or more of mounting, fastening, riveting, screwing, gluing, or welding. In another embodiment the one or more magnets are ferrite, ceramic, AlNiCo, neodymium iron boron or samarium cobalt magnets.

In an embodiment, the devices are tools, and the working material is selected from the group consisting of spackling, drywall compound, joint compound, parging, glue, grout, mortar, tiling compounds, tar-based materials and silicone.

DETAILED DESCRIPTION

Figure 1:
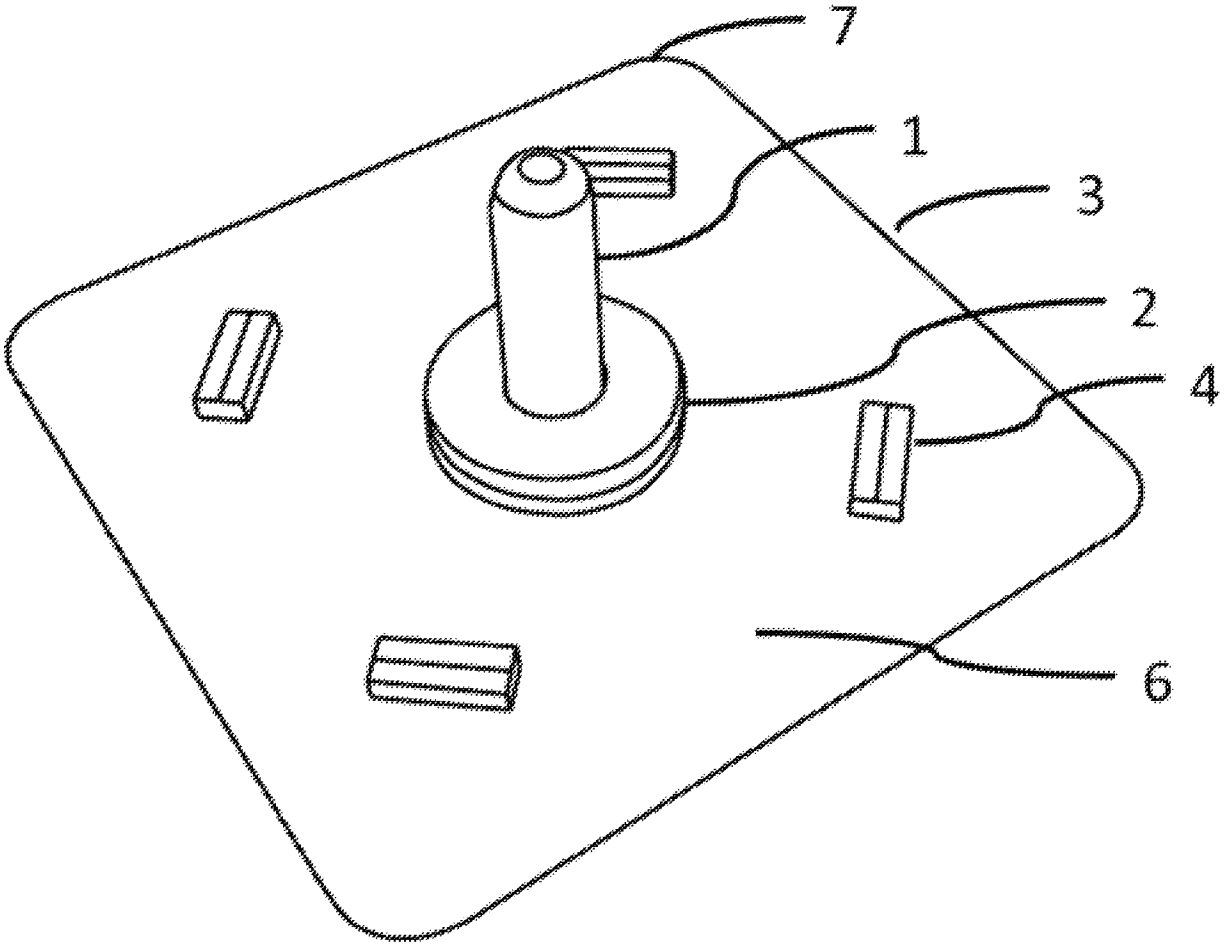
FIG. 1 shows the perspective view of an improved compound-containing device.

The expressions material, compound and joint compound maybe used interchangeably in the context of the present invention.

According to a first embodiment of a compound-containing device, a hawk consists of a plate 3, cushion ring 2 and a handle 1. Plate 3 has a top surface 5 and a bottom surface 6, and handle 1 is typically centered on bottom surface 6 of plate 3. Cushion ring 2 is placed between bottom surface 6 of plate 3 and handle 1 for cushioning the worker's hand while holding the prior art hawk.

Figure 2:
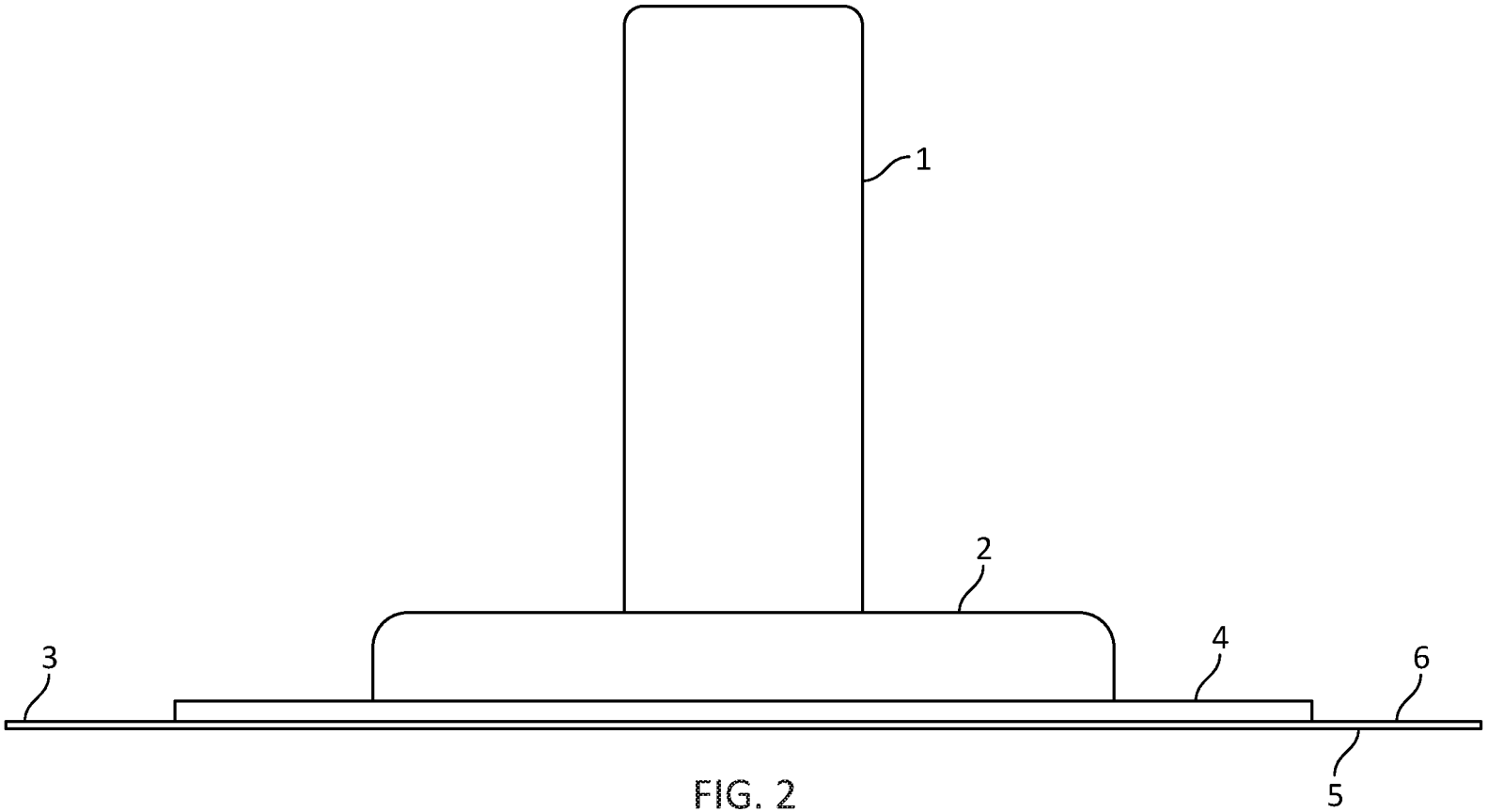
FIG. 2 shows the side view of an improved compound-containing device.
Figure 3:
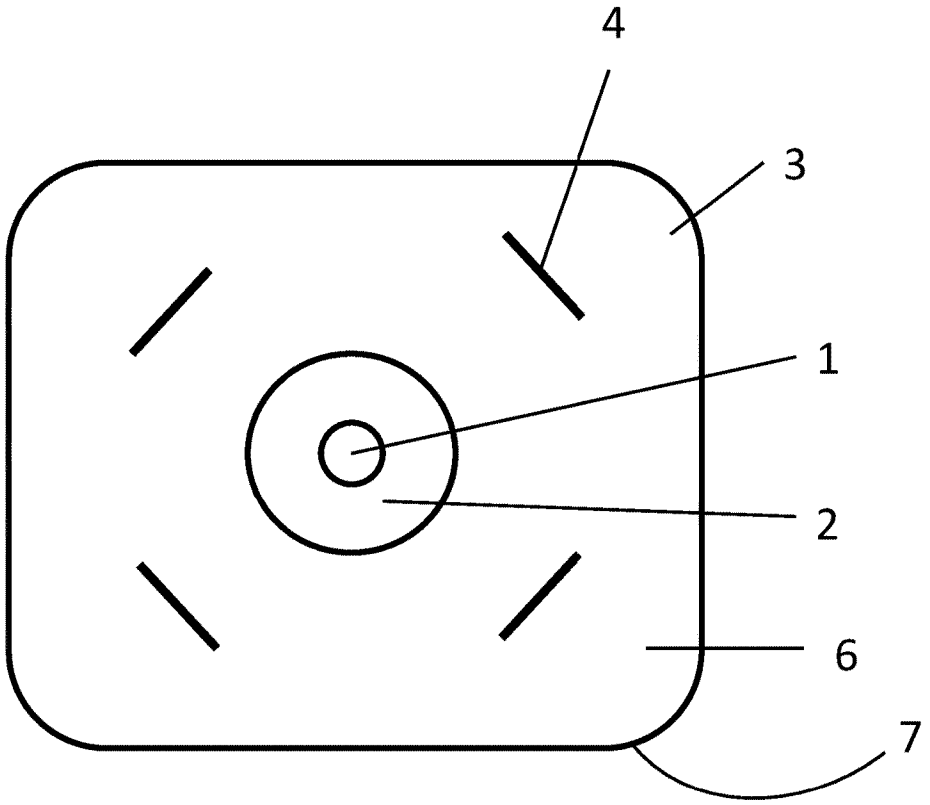
FIG. 3 shows the bottom view of an improved compound-containing device.

FIG. 1, FIG. 2 and FIG. 3 show an improved drywall hawk according to the invention, having retaining means for tools. FIG. 1 shows a perspective view, FIG. 2 shows an inverted elevation view, and FIG. 3 shows a bottom plan view of the hawk, which comprises plate 3 with a handle 1 placed on bottom surface 6 of plate 3. A cushion ring 2 is positioned between bottom surface 6 of plate 3 and handle 1, or mounted on bottom surface 6 of the plate 3 around handle 1, where the top of a worker's hand is likely to contact the plate 3. The plate 3 is preferably made of metal such as aluminum, however one skilled in the art would appreciate that a number of materials such as plastic or steel may be used with the same result. Cushion ring 2 is preferably made of sponge, rubber or a combination of both. Cushion ring 2 is for the comfort of the worker's hand and is also referred to as a callous preventer. Handle 1 is usually made of wood or rubber, but may be made of any material that can be used to hold plate 3.

Figure 4A:
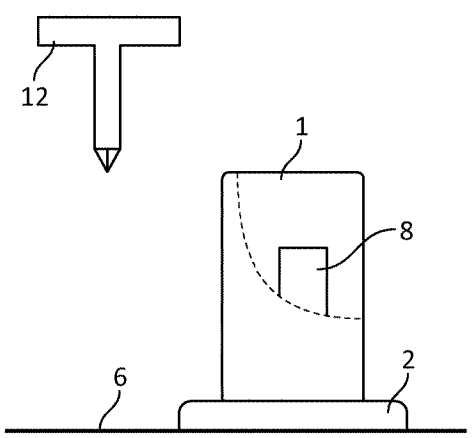
FIGS. 4*a*-4*f* show various embodiments of fastening means in the handle of the compound-containing device.
Figure 4B:
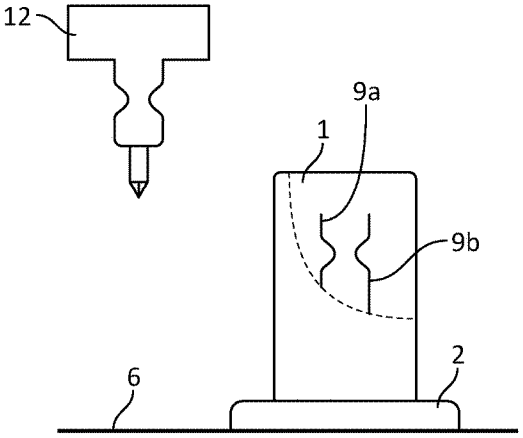
Figure 4C:
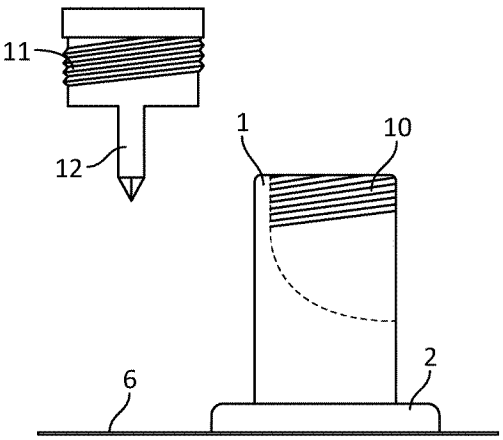
Figure 4D:
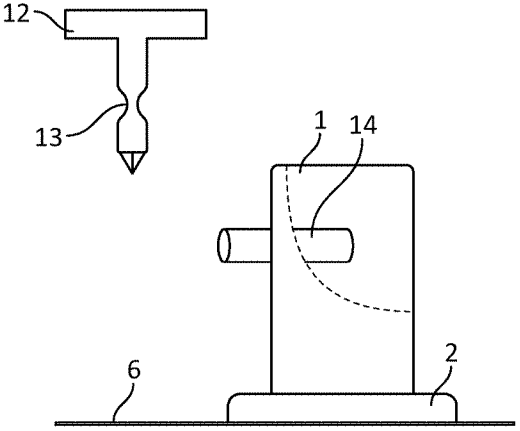
Figure 4E:
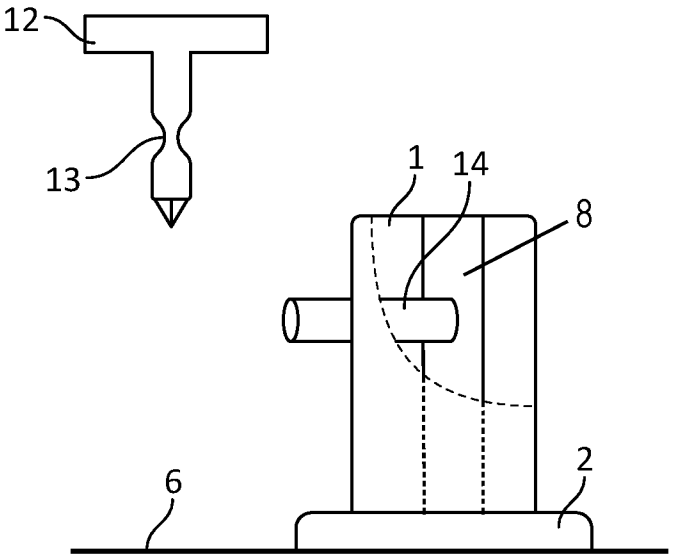
Figure 4F:
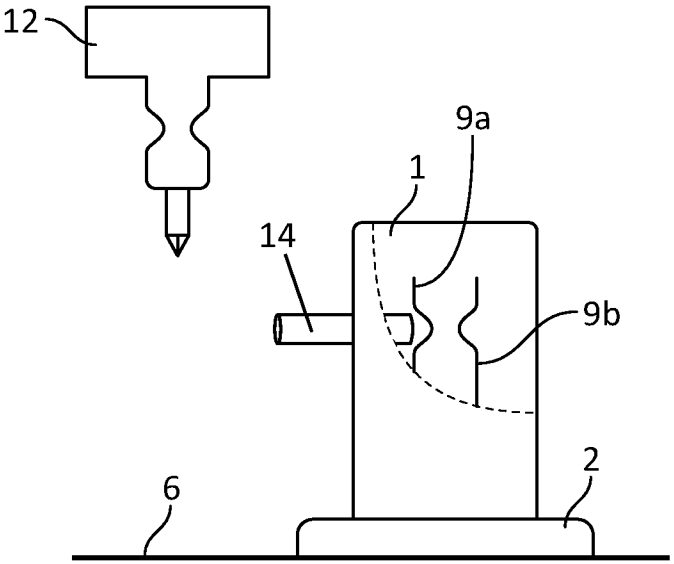

One or more magnets 4 are positioned on bottom surface 6 of plate 3, between cushion ring 2 and plate edge 7. The plate edge 7 wears down from usage, and the magnets 4 are preferably positioned far enough from the plate edge 7 to allow a reasonable amount of wear without exposing the edge of the magnet 4 from the worn plate edge 7. Further, magnet 4 should be far enough from cushion ring 2 and handle 1 so that the worker's hand does not push retained tools off magnet 4. In one embodiment, the magnets form a ring approximately equidistant between plate edge 7 and handle 1, the ring approximately coaxial with handle 1. In another embodiment, the magnets are in a square form approximately equidistant from handle 1 and edge 7, the centre of the square form coinciding with the axis of handle 1. Ideally, the magnets are placed such that a worker can move the tool underneath plate 3 and have the tool retained by magnets 4, without having to look to see the location of the magnets. The magnet may be of any type having a sufficient magnetism to hold a tool despite movement of the hawk, such as ferrite, ceramic, AlNiCo, Neodymium Iron Boron (NdFeB or NIB) and Samarium Cobalt (SmCo). It may be fastened to plate 3 by means of rivets, bolts, welding, or other means known in the art. The magnets 4 may be used to retain any device of interest to the worker, including tools such as screwdrivers, chisels or flashlights, FIGS. 4*a*-4*f* show other embodiments of the improved hawk. With reference to FIG. 4*a*, the improved hawk in this embodiment has a plate 3 with a handle 1 centered thereon. The handle 1 is hollow and contains a handle magnet 8 inside. Handle magnet 8 can be mounted within handle 1 by rivets, screws, welding or gluing, or other fastening means known in the art. The handle magnet 8 may be positioned at the end of the hollow handle 1, in an inverted cup form at the end of the handle 1 to guide tool 12 therein, or along the length of the handle, possibly even taking the inner shape of the handle, so as to form a magnetic aperture for the retention of a tool 12 having ferromagnetic components. In this embodiment of the invention, the worker removably places tools 12 such as screwdrivers and chisels in the hollow handle. Alternatively, With reference to FIG. 4*b*, retention means includes a clamping or a clipping means using a first clip 9*a* and a second clip 9*b*, held against one another by resilience of the material from which they are made (metal or plastic). This permits clipping and unclipping the tools easily, the tools being retained by friction of the clamps. With reference to 40, according to another embodiment, instead of using a retention means that is magnetic, tools such as screwdrivers and chisels may be retained in the handle by retention means that uses a threading 10 within the handle which connects with a treading 11 on the tool 12. These retention means may be combined together to create a more positive hold on the tool—see, for example, FIGS. 4*e* and 4*f* showing the locking pin in combination with i.) the handle magnet 8, and ii.) the first clip 9*a* and the second clip 9*b*, respectively. Alternatively, with reference to FIG. 4*d*, tools 12 may be retained within the handle 1 by a retention means that uses a locking pin system, Wherein a removable locking pin 14 passes through the handle 1 and through or into the tool 12, which has corresponding indents or apertures 13 therein to receive the pin 14.

In a further embodiment of the invention, a first magnet 4 is mounted on bottom surface 6 of plate 3, mounted in a ring spaced between handle 1 and plate edge 7, as described above. Handle 1 is made hollow to place a second magnet 8 in the handle. The worker retains tools such as knives and trowels against magnet 4 on bottom surface 6 of plate 3 and also magnetically retains tools such as screwdrivers and chisels against the handle magnet inside handle 1 of the hawk.

In a preferred embodiment of the present invention, when using the hawk a worker holds the hawk with handle 1 such that top surface 5 of plate 3 is facing up. The worker places material such as a joint compound on top surface 5 of plate 3. The worker also positions tools for retention against the magnet 4 affixed on bottom surface 6 of plate 3. Tools and devices such as taping knives, spackling knives, trowels, screw drivers, hammers or any other tools with ferromagnetic parts can be placed against magnet 4 of the hawk for retention. The above mentioned tools have parts which are usually made of different types of steel or iron and are attracted to magnets. Materials which are attracted to magnets are referred to as ferromagnetic or ferrous materials. Other parts such as screws and nails can also be placed against the magnet 4 on bottom surface 6 of plate 3. As a method of taping using the hawk, the worker takes a taping knife off magnet 4, takes some joint compound from top surface 5 of plate 3 and applies it on the drywall (not shown) to cover a hole or smooth the joint. The worker then replaces the taping knife (not shown) back on magnet 4, and may choose another tool such as a putty knife. In another method of use embodiment, the handle has magnet 8 retaining a screwdriver. The worker takes a screwdriver placed on top surface 5 of plate 3 and drives in a screw projecting out on the drywall. The worker then easily places back the screwdriver on plate 3. Then the worker may remove a taping knife from magnets 4 and using the mud that is on top of plate 3 begins taping and mudding a drywall joint. Then the taping knife can be returned to magnets 4 and the screwdriver removed again for use. In the alternative, two or more tools may be retained on magnets 4 such that the taping knife is returned to the magnets 4 and another tool such as a putty knife is removed and worked with. In the case of the hawk being designed to hold cement such as parging, the worker may use a trowel to apply parging, after which a putty knife is required for filling a small hole. Each time tools are changed between, the tool not being used is retained on the magnets 4 and the tool to be used is removed from the magnets and held by the worker's hand.

The worker has easy access to the tools and does not misplace the tools. Also, the worker is safe from the tools which were otherwise kept in his or her pockets. Also, it is a common problem in the prior art that the tools used for drywall and mortar applications wear away the plate of the hawk. The improved hawk has a magnet which can set in for the wearing away of the plate. Even when the plate wears away, the worker can use the magnet placed on bottom surface 6 of the plate to hold the joint compound.

Figure 5:
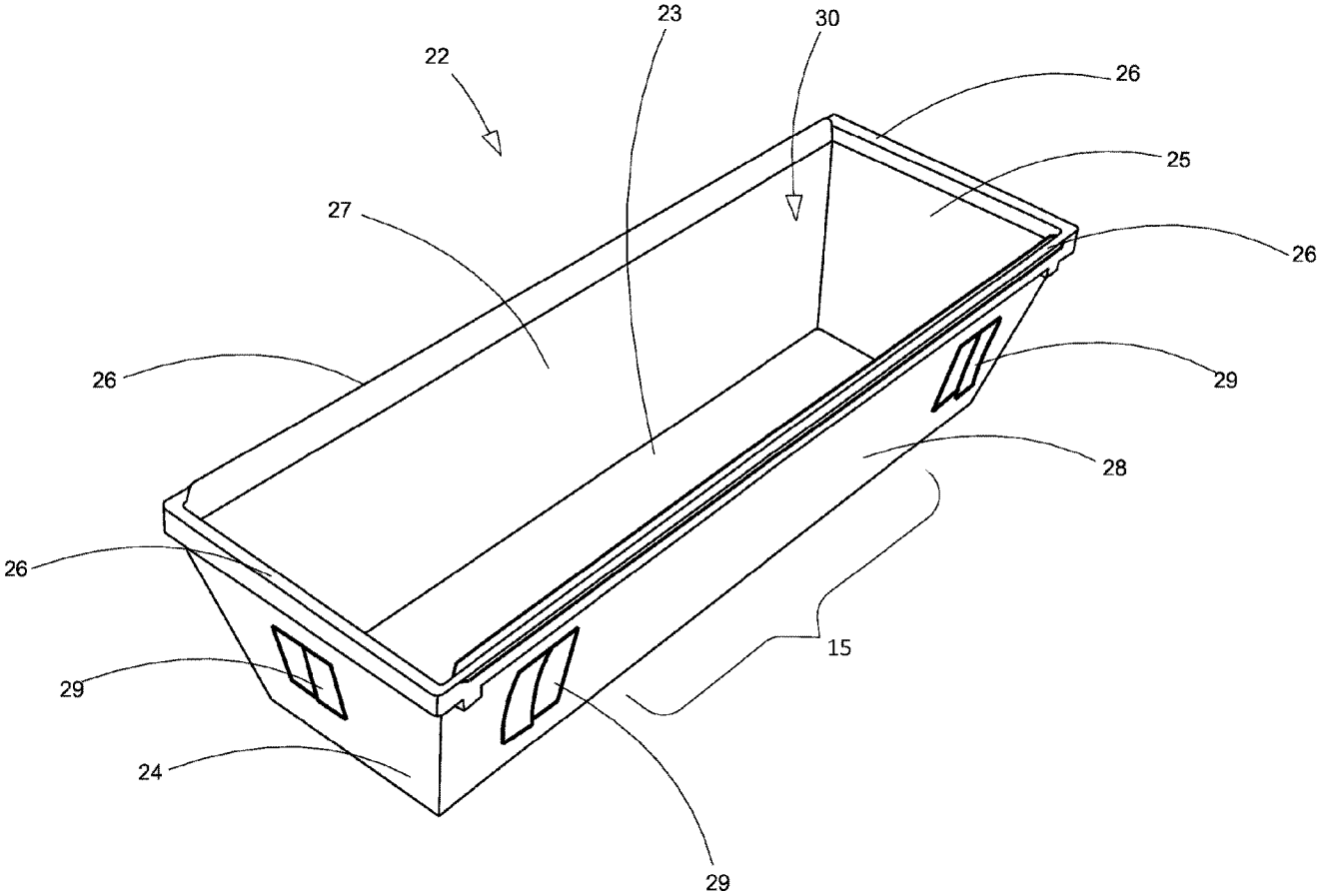
FIG. 5 shows the perspective view of a second embodiment of an improved compound-containing device.
Figure 6:
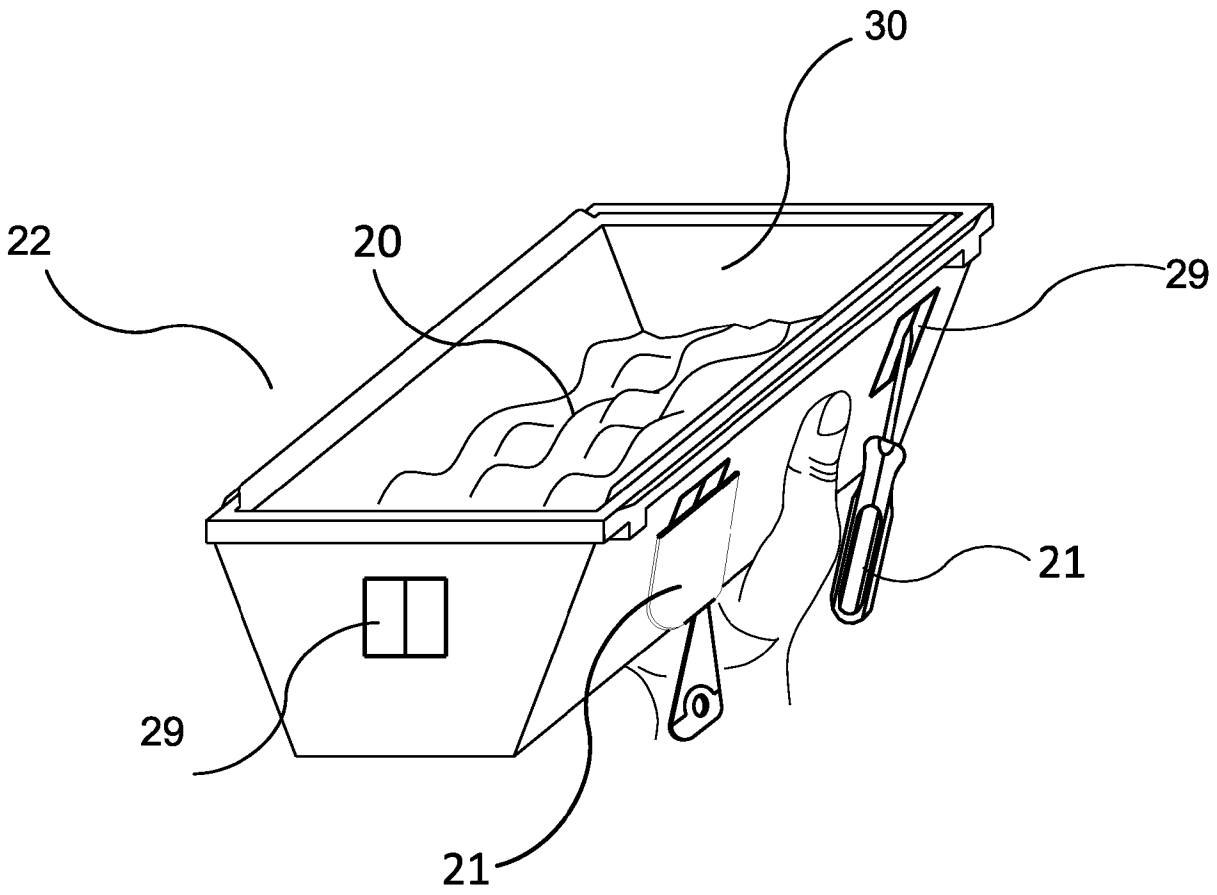
FIG. 6 shows second embodiment of an improved compound-containing device in use.

According to a second embodiment, and with reference to FIGS. 5 and 6, a pan 22 consists of a base 23, first and second ends 24, 25, and first and second sides 27, 28 all of which form sides to the base 23 and extend upwardly and outwardly from the base, such that the top edges 26 of the sides define an opening 30, which has a greater area than the area of the base 23.

One or more magnets 29 are positioned on the sides of the pan 22. The magnets 29 may be continuous around the sides of the pan 22, or may be placed in certain locations only. Preferably the magnet positions 29 allow the worker's hand to hold the pan without uncomfortable bumps from the magnets 29 impacting the hand, for example, by providing a magnet-free zone 15 for the hand to hold the pan. Examples of the magnet-free zone 15, in addition to being devoid of magnets, is rubber or silicone grips attached to the zones to aid in gripping, or indentations for the hand to facilitate a positive grip on the pan by means of the magnet-free zone. In one embodiment, the magnets 29 form a ring 16 approximately equidistant between the base 23 and the top edge 26. This ring 16 may be of a low-profile magnet, and/or may be set into the material of the sides so that no uncomfortable protrusions are encountered by the worker's hand. In another embodiment, the magnets 29 are concentrated near the first and second ends 24, 25, such that they are absent where the worker's hand generally holds the pan 22, near the middle 17, producing a magnet-free zone for the hand to hold the pan. Ideally, the magnets are placed such that a worker can remove and place a tool on the pan 22, without having to look to see the location of the magnets, so that he or she may keep their eyes on the task at hand. The magnet may be of any type having a sufficient magnetism to hold a tool despite movement of the pan as the worker is working, such as ferrite, ceramic, AlNiCo, neodymium iron boron (NdFeB or NIB) and samarium cobalt (SmCo). The one or more magnets 29 may be coupled to sides by means of mounting, fastening, riveting, screwing, gluing, and welding, or other means known in the art. The magnets 29 may be used to retain any device of interest to the worker, including tools such as screwdrivers, chisels or flashlights.

In another embodiment the magnets 29 are replaced or partially replaced by retention means includes a clamping or a clipping means known in the art, so as clip and unclip the tools easily, the tools being retained by friction of the clamps. These retention means and the magnets 29 may be combined together to create a more positive hold on the tool.

With reference to FIG. 6 and in a preferred embodiment of the present invention, when using the pan a worker holds the pan 22 such that the opening 30 is facing up and material can be placed within the pan. The worker places working material such as a joint compound 20 on base. The working material or compound may include spackling, drywall compound, joint compound, parging, glue, grout, mortar, tiling compounds, tar-based materials and silicone, as well as other spreadable and workable materials known in the art. The worker also positions tools for retention against the magnets 29 positioned around the sides. Tools and devices 21 such as drywall or taping knives, spackling knives, trowels, screwdrivers, hammers or any other tools with ferromagnetic parts can be placed against a magnet 29 of the pan for retention. The above mentioned tools have parts which are usually made of different types of steel or iron and are attracted to magnets. Materials which are attracted to magnets are referred to as ferromagnetic or ferrous materials. Other parts such as screws and nails can also be placed against the magnets 29. As a method of taping using the pan, the worker takes a taping knife off magnet 29, takes some joint compound from within the pan 22 and applies it on the drywall (not shown) to cover a hole or smooth the joint. The worker then replaces the taping knife (not shown) back on magnet 29, and may choose another tool such as a putty knife. In the alternative, two or more tools may be retained on magnets 29 such that the taping knife is returned to the magnets 29 and another tool such as a putty knife is removed and worked with. In the case of the pan 22 being designed to hold cement such as parging, the worker may use a trowel to apply parging, after which a putty knife is required for filling a small hole. Each time tools are changed between, the tool that is not being used is retained on the magnets 29 and the tool to be used is removed from the magnets 29 and held by the worker's hand.

In one embodiment, a method for applying drywall compound to a surface with two or more tools 21 magnetically attached to a pan 22, comprising the steps of a) adding a working material to the pan; b) removing at least part of the working material from the pan with a first tool; c) applying the at least part of the working material to the surface with the first tool; d) placing the first tool against one or more magnets coupled to the pan; e) removing a second tool from the one or more magnets coupled to the pan; and f) working with the surface with the second tool. Working with the surface may include smoothing tape using a drywall knife, or tightening screws or other drywall fastening means known in the art to smooth the surface to prepare it for treatment with tape. In the method described above, the first tool may be a drywall knife and the second tool may be a screwdriver to tighten protruding drywall screws.

As a result of the improved pan 22, the worker has easy access to the tools and does not misplace the tools. Also, the worker is safe from the tools which were otherwise kept in his or her pockets or toolbelt, which could pierce the worker in case of a fall. The pan may be used without the need of the worker looking at the magnets for fastening, since the worker can see the pan from the corner or his eye or will move the tool close to his hand to find the magnet retention. This convenient use is in opposition to a toolbelt, which must be looked at to determine the location of pockets or loops for holding the tools. Similarly, retention means such as a hole in the lip of the pan would require the concentration of the worker to fit the tool therein, and the tool would need to be oriented in a particular manner, a requirement that is absent with the use of the magnetic retention means herein described.

A further benefit of using magnets as retention means is that they continue to function despite coating by drywall compound or other compounds. Similarly, a tool coated in compound will still be retained by the magnet as the magnetic connection is sufficiently strong to pass through compound or other coatings. A mechanical retention means will become clogged by the compound and will cease to work. As the magnets are smooth any coating is easily removed therefrom by striking, scraping or soaking. Magnets are chosen so as to be sufficiently strong to provide a magnetic force that permeates any coating, as well as resisting jarring or bumping, so that the tools are not released unintentionally from the magnets.

Expressions such as drywall, hawk, and material, compound should not be taken as to limit the scope of the invention and include all other objects and applications with which the present invention could be used. For example a hawk can be used with any surface for applying any type of material not restricted to the ones mentioned in this invention. The improved hawk and its parts could be made of other materials, know to workers skilled in the art, and are not restricted to the ones mentioned in this disclosure.

I claim:

1. A hawk comprising:

a. a plate;

b. a handle defined by an upper end mounted to a bottom surface of the plate, a lower end having an aperture that opens into a hollow interior of the handle, and a side wall extending between the upper end and the lower end, the sidewall having an aperture extending there through into the hollow interior;

c. a locking pin; and d. one or more tools, each of the tools having a handle end and a working end, wherein a first end of the locking pin passes through the sidewall aperture and engages an indent or an aperture in the working end of the one or more tools to releasably retain at least the working end within the handle's hollow interior when not in use, and wherein a second end of the locking pin extends outwardly beyond an outer surface of the handle when the first end is engaged with the one or more tools.

2. The hawk of claim 1, further comprising one or more magnets mounted to the bottom surface of the plate, wherein the one or more magnets form a ring coaxial with the handle.

3. The hawk of claim 1, further comprising one or more magnets mounted to the bottom surface of the plate, wherein the one or more magnets are positioned between the handle and a plate edge.

4. The hawk of claim 1, further comprising a cushion ring mounted on the bottom surface of the plate around the handle.

5. A hawk according to claim 1, further comprising one or more magnets mounted to the bottom surface of the plate using one or more fastening means selected from the group consisting of riveting, screwing, gluing, and welding.

6. A hawk according to claim 1, further comprising one or more magnets mounted to the bottom surface of the plate, wherein the one or more magnets are ferrite, ceramic, AlNiCo, Neodymium Iron Boron or Samarium Cobalt magnets.

7. The hawk of claim 1, further comprising a magnet positioned within the hollow interior of the handle.

8. The hawk of claim 1, further comprising a clamping means positioned within the hollow interior of the handle and in parallel with a longitudinal axis of the handle, wherein the clamping means matingly engages, and retains, the working end of the one or more tools within the handle's hollow interior when not in use.

9. The hawk of claim 1, further comprising a cushion ring between bottom surface of the plate and the handle.

10. A hawk comprising:

a. a plate;

b. a handle defined by an upper end mounted to a bottom surface of the plate, a lower end having an aperture that opens into a hollow interior of the handle, and a side wall extending between the upper end and the lower end;

c. one or more tools, each of the tools having a handle end and a working end, wherein at least the working end is retained within the handle's hollow interior when not in use; and d. a retaining means for retaining the one or more tools within the handle, the retaining means selected from the group consisting of:

i. a magnet positioned within the hollow interior of the handle, the magnet extending entirely from the lower end of the handle to the upper end of the handle;

ii. a clamping means positioned within the hollow interior of the handle and in parallel with a longitudinal axis of the handle, wherein the clamping means extends from the upper end of the handle to matingly engage the working end of the one or more tools.

11. A hawk comprising:

a. a plate;

b. a handle defined by an upper end mounted to a bottom surface of the plate, a lower end having an aperture that opens into a hollow interior of the handle, and a side wall extending between the upper end and the lower end, the sidewall having a circular aperture extending there through into the hollow interior;

c. a rod-shaped locking pin; and d. one or more tools, each of the tools having a handle end and a working end, wherein the locking pin passes through the sidewall aperture and engages an indent or an aperture in the working end of the one or more tools to releasably retain at least the working end within the handle's hollow interior when not in use.

* * * * *